US008948643B2

(12) United States Patent
Winters

(10) Patent No.: US 8,948,643 B2
(45) Date of Patent: Feb. 3, 2015

(54) METHOD AND SYSTEM FOR CONTROLLING MULTIPLE PRINTERS IN A TISP OR TIPP SYSTEM FOR INCREASED STABILITY

(75) Inventor: James A. Winters, Alfred Station, NY (US)

(73) Assignee: Xerox Corporation, Norwalk, CT (US)

( * ) Notice: Subject to any disclaimer, the term of this patent is extended or adjusted under 35 U.S.C. 154(b) by 717 days.

(21) Appl. No.: 13/173,136

(22) Filed: Jun. 30, 2011

(65) Prior Publication Data

US 2013/0004186 A1 Jan. 3, 2013

(51) Int. Cl.
*G03G 15/00* (2006.01)

(52) U.S. Cl.
CPC .. *G03G 15/5083* (2013.01); *G03G 2215/00109* (2013.01); *G03G 2215/2083* (2013.01)
USPC ..... 399/82; 399/46; 399/26

(58) Field of Classification Search
USPC ..... 399/9, 11, 24, 28–29, 31, 46–49, 76, 399/77, 364; 358/1.15
See application file for complete search history.

(56) References Cited

U.S. PATENT DOCUMENTS

| | | | | |
|---|---|---|---|---|
| 6,814,004 | B2 | 11/2004 | Lofthus et al. | |
| 7,417,755 | B2 * | 8/2008 | Imaizumi et al. | 358/1.15 |
| 2005/0034613 | A1 | 2/2005 | Lofthus et al. | |
| 2006/0268317 | A1 * | 11/2006 | Lofthus et al. | 358/1.15 |
| 2006/0285159 | A1 * | 12/2006 | Frankel | 358/1.16 |
| 2008/0089710 | A1 | 4/2008 | Lofthus et al. | |
| 2008/0313635 | A1 * | 12/2008 | Rai | 718/102 |

* cited by examiner

*Primary Examiner* — Clayton E Laballe
*Assistant Examiner* — Jessica L Eley
(74) *Attorney, Agent, or Firm* — Fay Sharpe LLP

(57) ABSTRACT

A method for printer stability enhancement in a multiple printer printing system includes determining a first printer stress state of a first printer in a printing system, wherein the first printer is assigned a first printing role. A second printer stress state of a second printer in the printing system is also determined, wherein the second printer is assigned a second printing role that is different from the first printing role. The first printer stress state is compared to the second printer stress state, and the first printing role is reassigned to the second printer and the second printing role is reassigned to the first printer if the first printer stress state is different than the second printer stress state. A printing system implementing the method is also provided.

8 Claims, 4 Drawing Sheets

| | PRINTER #1 STRESS PARAMETERS | DELTA Δ | PRINTER #2 STRESS PARAMETERS | |
|---|---|---|---|---|
| FP1 | TONER AGE | Δ1 | TONER AGE | SP1 |
| FP2 | TONER CONCENTRATION | Δ2 | TONER CONCENTRATION | SP2 |
| FP3 | AREA COVERAGE | Δ3 | AREA COVERAGE | SP3 |
| FP4 | STREAKS | Δ4 | STREAKS | SP4 |
| FP5 | DEVELOPMENT FIELD | Δ5 | DEVELOPMENT FIELD | SP5 |
| FP6 | LASER POWER (ROS) | Δ6 | LASER POWER (ROS) | SP6 |
| FP7 | CHARGE LEVEL | Δ7 | CHARGE LEVEL | SP7 |

FIG. 3

METHOD AND SYSTEM FOR CONTROLLING MULTIPLE PRINTERS IN A TISP OR TIPP SYSTEM FOR INCREASED STABILITY

BACKGROUND

Currently, two or more printers (or "print engines") are combined in a Tightly Integrated Serial Printing (TISP) system or a Tightly Integrated Parallel Printing (TIPP) system to provide a single print system of higher capacity and with other advantages. In such known systems, each printer is assigned a specific dedicated printing role. For example, a first printer of a TISP/TIPP printing system is assigned a first printing role of "side one printing" of pages and a second printer of the TISP/TIPP printing system is assigned a second printing role of "side two printing" of pages. Such dedication of printing roles provides advantages, but can also lead to problems. In particular, the first and second printers often migrate to different overall states of relative print quality, performance, and efficiency (referred to herein as "stress states") due to differences in the printing roles performed thereby. In the above example, the side one printing duties defining the first printing role can be more demanding in terms of amount of printed output generated as compared to the side two printing duties defining the second printing role. This variation in the amount of printed output often causes the first and second printers to diverge from each other in terms of quality, replenishment of colorant (ink or toner), remaining useful life of wear parts, etc., which can be thought of as a lack of stability in the TISP/TIPP system. Any variation in quality is highly objectionable to the user, and the divergence in terms of consumption of colorant, useful life of wear components, and the like leads to inefficiencies in connection with supply usage and maintenance requirements. As such, a need has been identified for a new and improved method and system for controlling multiple printers in a TISP or TIPP system for increased stability.

SUMMARY

In accordance with a first aspect of the present development, a method for printer stability enhancement in a multiple printer printing system includes determining a first printer stress state of a first printer in a printing system, wherein the first printer is assigned a first printing role. The method further includes determining a second printer stress state of a second printer in the printing system, wherein the second printer is assigned a second printing role that is different from the first printing role. The first printer stress state is compared to the second printer stress state, and the first printing role is reassigned to the second printer and the second printing role is reassigned to the first printer if the first printer stress state is different than the second printer stress state.

In accordance with another aspect of the present development, a system for printer stability enhancement in a multiple printer printing system includes a first printer assigned a first printing role and a second printer assigned a second printing role that is different from the first printing role. The system further includes means for reassigning the first printing role to the second printer and for reassigning the second printing role to the first printer after completion of a printing cycle.

In accordance with a further aspect of the present development, a system for printer stability enhancement in a multiple printer printing system includes means for determining a first printer stress state of a first printer in a printing system, wherein the first printer is assigned a first printing role. The system further includes means for determining a second printer stress state of a second printer in the printing system, wherein the second printer is assigned a second printing role that is different from the first printing role. The system also includes means for comparing the first printer stress state to the second printer stress state, and means for reassigning the first printing role to the second printer and reassigning the second printing role to the first printer if the first printer stress state is different than the second printer stress state.

BRIEF DESCRIPTION OF DRAWINGS

FIG. 3 is chart that illustrates examples of printer stress parameters used in the system and method according to the present development;

DETAILED DESCRIPTION

Figure 1:
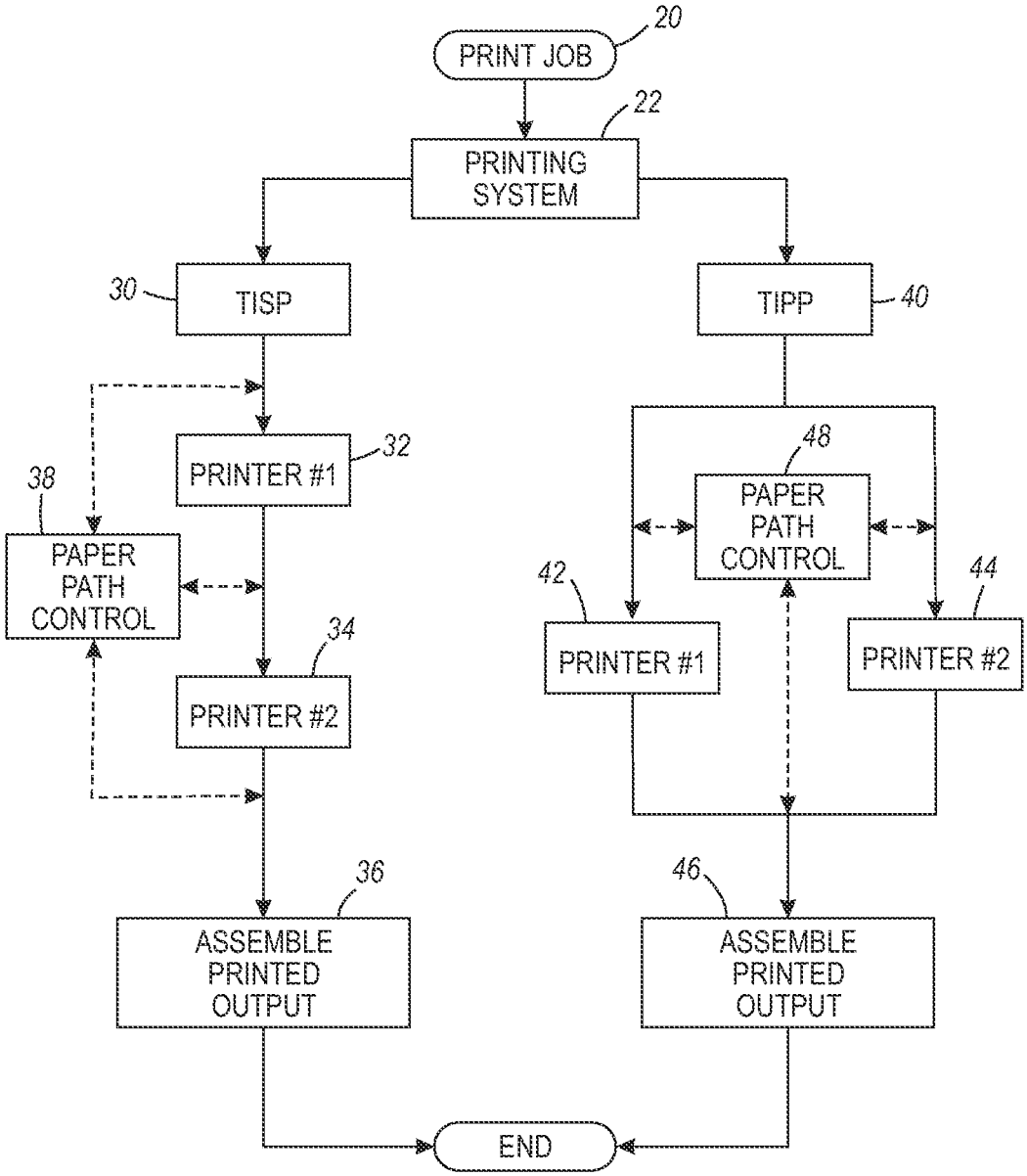
FIG. 1 (Prior Art)
FIG. 1 illustrates a conventional TISP/TIPP printing system.

As shown in FIG. 1, a print job 20 is input to a multiple printer printing system 22 that is provided as a Tightly Integrated Serial Printing (TISP) printing system 30 and/or a Tightly Integrated Parallel Printing (TIPP) printing system 40. The print job 20 includes first and second printing roles, e.g., with the first printing role being defined as printing side one of each page and the second printing role being defined as printing side two of each page, or the first printing role being defined as printing text and the second printing role being defined as printing images and graphics, or any other divisional of roles in a multiple printer printing system.

The TISP printing system 30 is configured such that a first printing role of the print job 20 is performed by a first printer 32 (Printer #1) that is located upstream from a second printer 34 (Printer #2) that performs a second printing role of the print job 20 after the first printing role performed by the first printer 32 is completed. The second printer 34 outputs the print job to a printed output module 36 for assembling the hard copy paper printed output into the desired physical arrangement or package. The TISP printing system 30 also includes a paper path control system 38 comprising gates, inverters, cross-overs and the like, for controlling the flow of paper (or other print recording media) to and from the first and second printers 32,34.

Similarly, in the TIPP printing system 40, a first printing role of the print job 20 is performed by a first printer 42 (Printer #1) that is arranged and operates in parallel with a second printer 44 (Printer #2) that performs a second printing role of the print job 20 simultaneously with the first printing role performed by the first printer 42. The first and second printers 42,44 output their respective print jobs to a printed output module 46 for assembling the hard copy paper printed output into the desired physical arrangement or package. The TIPP printing system 40 also includes a paper path control system 48 comprising gates, inverters, cross-overs and the like, for controlling the flow of paper (or other print recording media) to and from the first and second printers 42,44.

Figure 2:
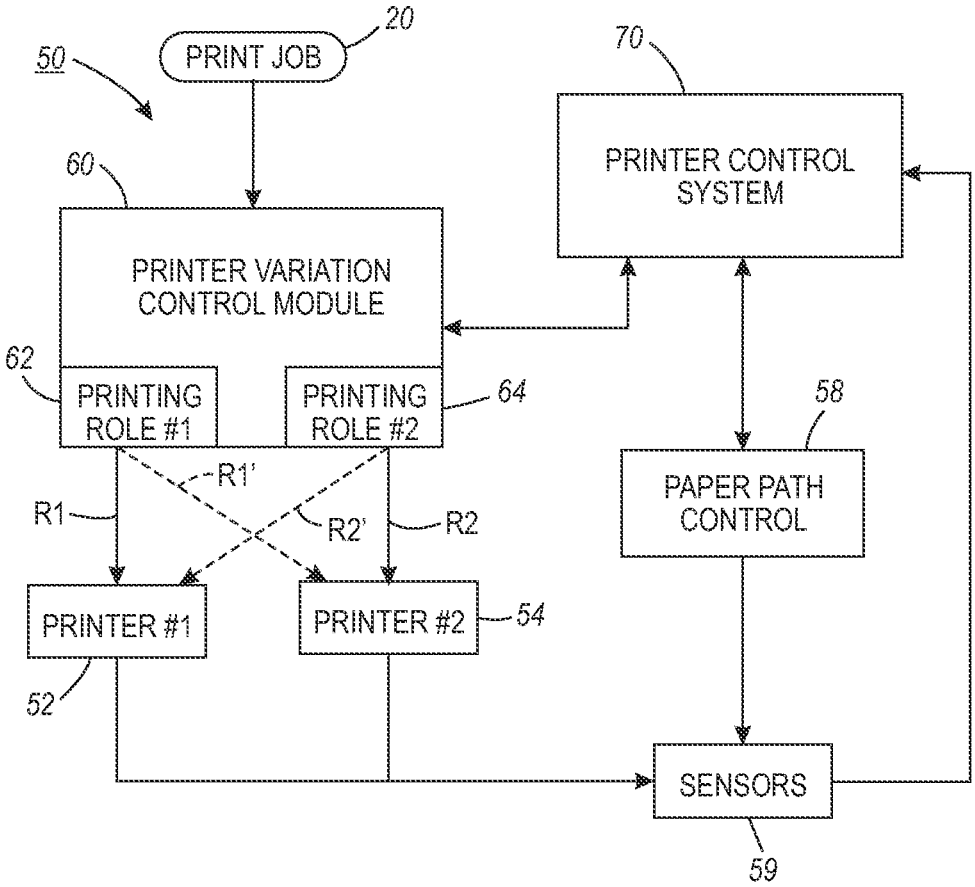
FIG. 2 illustrates a TISP/TIPP printing system provided in accordance with the present development.

As noted above, the stress states of the first and second printers 32,34 or 42,44 will often undesirably diverge relative to each other over time. FIG. 2 illustrates either a TISP or a TIPP printing system 50 provided in accordance with the present development including a first printer 52 (Printer #1) and a second printer 54 (Printer #2) arranged in a TISP or TIPP arrangement (the relative location of the first and second printers 52,54 in FIG. 2 is not intended to be limited to either a TISP or TIPP system). Unlike the TISP and TIPP systems 30,40 of FIG. 1, the multiple-printer system 50 shown in FIG. 2 is structured and configured to enhance stability and reduce stress state variation between the first and second printers 52,54. As such, the system 50 comprises a printer variation control module 60 that receives the data defining the print job 20. The printer variation control module 60 divides the print job 20 into at least a first printing role 62 (Printing Role #1) and a second printing role 64 (Printing Role #2). As indicated by the solid-line arrows R1 and R2, in a first or default state, the printer variation control module 60 outputs the data associated with and defining the first printing role 62 to the first printer 52 and outputs the data associated with and defining the second printing role 64 to the second printer 54. As indicated by the broken-line arrows R1' and R2', in a second or default state, the printer variation control module 60 outputs the data associated with and defining the first printing role 62 to the second printer 54 and outputs the data associated with and defining the second printing role 64 to the first printer 52. The system 50 comprises a printer control system 70 that is operably connected to the printer variation control module 60 (e.g., the printer variation control module 60 can be provided by software and/or hardware implemented in the control system 70, itself, or it can be a separate hardware and/or software module). The printer control system 70 and the printer variation control module 60 are provided by electronic circuitry and/or other hardware and/or software that is dedicated to digital image processing and/or can comprise a general purpose computer programmed to implement the image processing operations disclosed herein.

In response to input received by the printer control system 70, or according to an arbitrary or pre-defined schedule, the printer control system 70 provides input to the printer variation control module 60 to cause the printer variation control module 60 to select either its first state as indicated by the solid-line arrows R1,R2 or its second state as indicated by the broken-line arrows R1',R2'. In other words, the printer control system 70 periodically causes the printer variation control module 60 to reassign the first printing role 62 to the second printer 54 and to reassign the second printing role 64 to the first printer 52, and vice versa. The printer control system 70 also receives some or all of the data defining the print job 20 for reasons described below.

As shown in FIG. 2, the system 50 also comprises a paper path control system 58 comprising gates, inverters, crossovers and the like, for controlling the flow of paper (or other print recording media) to and from the first and second printers 52,54. The paper path control system 58 is controlled by the printer control system 70 and also provides feedback to the control system 70. The system 50 further comprises multiple sensors 59 associated with the first and second printers 52,54 for providing sensor data to the printer control system 70. In particular, the sensors 59 associated with the first printer 52 provide first printer stress data input to the printer control system 70. The first printer stress data describe and relate to the stress state of the first printer. The sensors 59 associated with the second printer 54 provide second printer stress data input to the printer control system 70. The second printer stress data describe and relate to the stress state of the second printer. Examples of sensors 59 and the printer stress data output thereby include: (i) environmental sensors (temperature, humidity, etc.); (ii) toner usage, toner concentration, toner reservoir data sensors; (iii) streak sensors for detecting streaks on the photoreceptor; (iv) electrical sensors for measuring the development field, laser power, charge level, and the like that provide information to the printer control system concerning the printing operation being performed by the first and second printers 52,54 and the stress states of the first and second printers 52,54. The sensors also include paper sensors and other sensors in the paper path; and other known sensors.

The printer control system 70 receives data from the sensors 59 and also uses the data defining and describing the print job 20 to calculate or otherwise derive first printer stress parameters that describe or indicate a stress state of the first printer 52 and to calculate or otherwise derive second printer stress parameters that describe or indicate a stress state of the second printer 54. FIG. 3 is chart that illustrates examples of the first printer stress parameters FP1-FP7 and the corresponding second printer stress parameters SP1-SP7. Each first printer stress parameter FP1-FP7 respectively relates to a corresponding second printer stress parameter SP1-SP7. As such, the printer control system 70 calculates or otherwise determines a respective stress parameter difference or "delta" Δ1-Δ7 between each corresponding pair of the first and second printer stress parameters FP1-FP7 and SP1-SP7. It is not intended that the present development be limited to the first and second printer stress parameters listed in FIG. 3. Those of ordinary skill in the art will recognize that the present development is intended to encompass these and/or other printer stress parameters and is not to be limited to the particular stress parameters disclosed herein.

A description of each printer stress parameter FP1-FP7, SP1-SP7 is provided below:

Toner Age (FP1,SP1)

This parameter describes the age of the toner (or other colorant) in terms of the time it has been residing in the development housing/sump, typically described in terms of a "mean residence time." The printer control system 70 uses the fixed size of the development housing, the amount of toner input to the development housing and the amount of toner consumed from the development housing over a known time period to calculate the toner age parameter. A variation in toner age between the first and second printers 52,54 indicates a variation in printer stress levels.

Toner Concentration (FP2,SP2)

This parameter describes the concentration of toner relative to carrier beads or other carrier material in the two-component development housing or sump. The toner concentration is measured by one of the sensors 59 and is controlled by the printer control system 70 in real-time to adjust the image density of the printed output. A variation in toner concentration between the first and second printers 52,54 indicates a variation in printer stress levels due to variations in printed output.

Area Coverage (FP3,SP3)

This parameter describes the quantity of toner being output by each printer 52,54 in terms of the area covered by the toner or other colorant. The printer control system 70 derives the area coverage parameter from the data defining the print job 20. Variation in area coverage between the first and second printers 52,54 indicates a variation in printer stress levels.

Streaks (FP4,SP4)

This parameter describes the detection of streaks on the photoreceptor of the printer as detected by full-width array sensors. Detection of streaks associated with one of the printers 52,54 but not the other indicates a variation in printer stress levels.

Development Field (FP5,SP5)

This parameter describes the voltages and other electrical characteristics of the xerographic field including the magnetic roller. The development field is measured by sensors 59 and/or is known and controlled by the printer control system 70. Differences in the development field between the first and second printers 52,54 indicates a variation in printer stress.

Laser Power/ROS (FP6,SP6)

The laser (Raster Output Scanner (ROS)) power consumed is known by the printer control system 70. An increase in laser power consumption indicates that greater power is required to maintain the desired image density. As such, a variation in laser power between the first and second printers 52,54 indicates different levels of printer stress.

Charge Level (FP7,SP7)

The charge level on the photoreceptor is known by the printer control system 70 and/or is measured by sensors 59. Variation in charge levels between the first and second printers 52,54 indicates different levels of printer stress due to component wear or other reasons.

Figure 4:
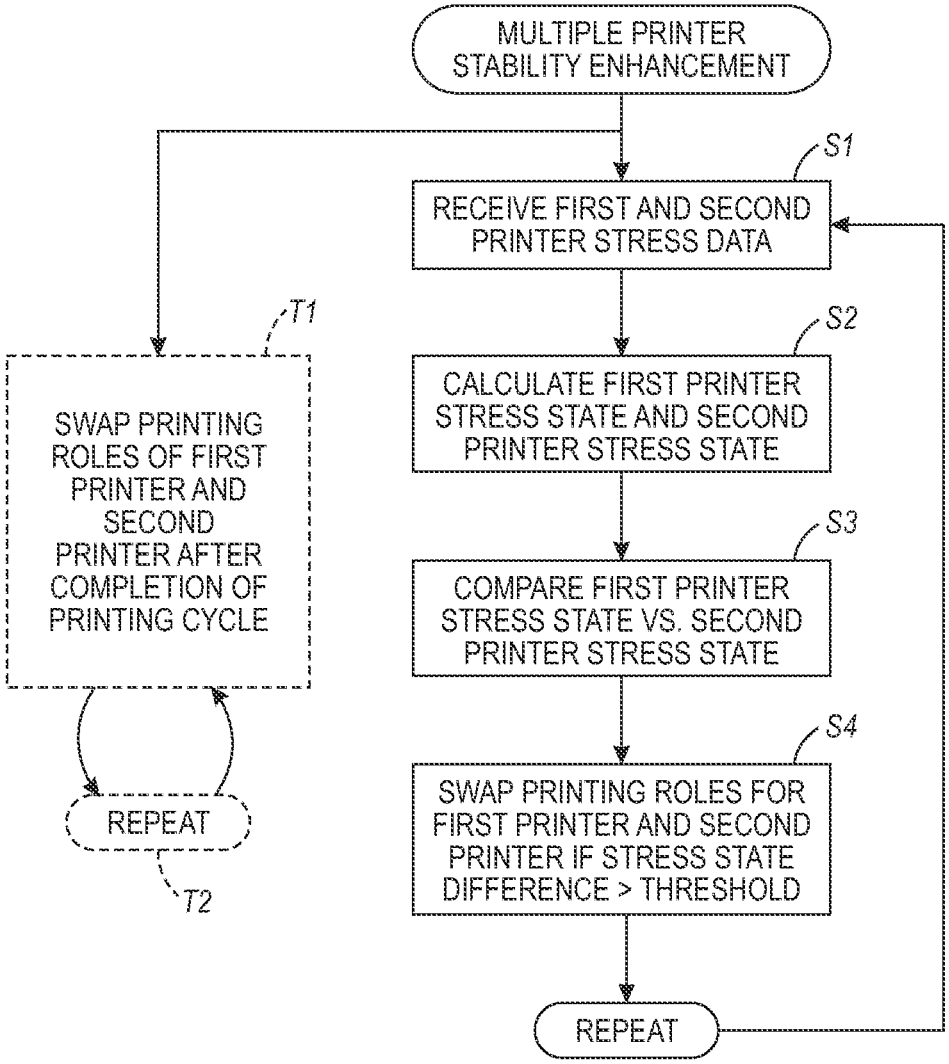
FIG. 4 illustrates a method for multiple printer stability enhancement according to an exemplary embodiment.

FIG. 4 illustrates a method for multiple printer stability enhancement according to an exemplary embodiment, using the TISP/TIPP system 50 of FIG. 2 or another multiple-printer printing system. In a step S1, the printer control system 70 receives the first and second printer stress data, i.e., the first and second printer stress parameters and/or the data required to derive the first and second printer stress parameters. In a step S2, the control system 70 uses the printer stress data received in step S1, data from the input print job 20, and other printer stress parameters available to it as described above to calculate a first printer stress state for the first printer 52 and a second printer stress state for the second printer 54. In a step S3, the control system 70 compares the first printer stress state and the second printer stress state. In a step S4, the control system 70 controls the printer variation control module 60 to swap the printing roles for the first and second printers 52,54 as described above if the difference between the first and second stress states is greater than a select threshold. As such, if the difference between the first and second stress states is greater than the select threshold then:

- if the first printing role is being performed by the first printer 52 and the second printing role is being performed by the second printer 54, the step S4 will cause the first printing role to be performed by the second printer 54 and the second printing role to be performed by the first printer 52; and
- if the first printing role is being performed by the second printer 54 and the second printing role is being performed by the first printer 52, the step S4 will cause the first printing role to be performed by the first printer 52 and the second printing role to be performed by the second printer 54.

The steps S1-S4 are then repeated continuously while the printing system 50 is active.

In one embodiment, the select threshold used in step S4 is exceeded if any one of the stress parameter deltas Δ1-Δ7 does not equal zero. In another embodiment, the select threshold used in step S4 is exceeded if any one of the stress parameter deltas Δ1-Δ7 varies by 10% or more from either of the respectively corresponding first and second printer stress parameters FP1-FP7, SP1-SP7 used to calculate the stress parameter delta Δ1-Δ7, i.e., if the second printer stress parameter varies from the first stress parameter by 10% or more of the first stress parameter or vice versa. In other words, a tolerance range of plus or minus 10% is assigned to each of the stress parameter deltas Δ1-Δ7, and each stress parameter delta Δ1-Δ7 is deemed to indicate printer stress variation only if it falls outside the tolerance range. Also, the threshold used in step S4 can be deemed to be exceeded if one, greater than one, or all available stress parameter deltas Δ1-Δ7 fall outside the tolerance range. As such, printer stress variation indicated by any one or more of the of the stress parameter deltas Δ1-Δ7 can be ignored until a select minimum number of the available stress parameter deltas Δ1-Δ7 fall outside the tolerance range as would indicate printer stress variation outside an acceptable range.

Those of ordinary skill in the art will recognize that the above-described swapping of the first and second printing roles between the first and second printers 52,54 according to the step S4 will ensure that the variation between the respective stress states of the first and second printers 52,54 is maintained within acceptable limits.

FIG. 4 also illustrates an alternative embodiment for a multiple printer stability enhancement method in accordance with the present development. The method comprises a step T1 in which the control system 70 controls the printer variation control module 60 to swap the printing roles for the first and second printers 52,54 as described above after completion of a predetermined fixed or arbitrarily variable printing cycle. The printing cycle is defined in terms of time, number of sheets, toner usage, data printed, and/or any other parameter related to time and/or printing activity of the system 50. According to the present development, the print cycle can be defined in any desired manner as noted such that the first and second printers 52,54 swap roles periodically as controlled by the printer control system 70 in a manner that is seamless to the user in order to reduce stress variations between the printers. A printing cycle can be defined as a select number of print jobs, pages, time (minutes, hours, days, etc.) or other criteria related to the activity of the printing system 50. As indicated by the step T2, the process is repeated while the printing system 50 is active. As such, according to the step T1:

- if the first printing role is being performed by the first printer 52 and the second printing role is being performed by the second printer 54, the step T1 will cause the first printing role to be performed by the second printer 54 and the second printing role to be performed by the first printer 52; and
- if the first printing role is being performed by the second printer 54 and the second printing role is being performed by the first printer 52, the step T1 will cause the first printing role to be performed by the first printer 52 and the second printing role to be performed by the second printer 54.

This periodic swapping of the first and second printing roles between the first and second printers 52,54 will ensure that variation of between the respective printer stress states of the first and second printers 52,54 is controlled so as to be maintained within a required range.

The present development will reduce toner consumption by reducing the likelihood that the toner age FP1,SP1 of either printer 52,54 becomes elevated. In known systems 30,40, when the toner age reaches a maximum acceptable level, the system will perform a MAC (Minimum Area Coverage) Patch and/or Toner Purge routine to use toner for waste purposes by printing colorant patches on the photoreceptor and then wiping the patches into the waste toner hopper in order to drive the toner age down to an acceptable level. The system 50 and method of the present development reduces the chance that the toner age in either printer will reach the maximum acceptable level, because both printers will be used in a uniform manner relative to each other.

The claims, as originally presented and as they may be amended, are intended to encompass variations, alternatives, modifications, improvements, equivalents, and substantial equivalents of the embodiments and teachings disclosed herein.

The invention claimed is:

1. A method for printer stability enhancement in a multiple printer printing system, said method comprising:

receiving into a multiple printer printing system a print job comprising first and second printing roles;

assigning said first printing role to a first printer of said printing system;

assigning said second printing role to a second printer of said printing system;

using said first printer to perform said first printing role and using said second printer to perform said second printing role;

determining a first printer stress state of the first printer of the printing system, wherein said step of determining the first printer stress state comprises receiving first printer stress data from said first printer, said first printer stress data comprising data that relate to a plurality of first printer stress parameters including at least two of: first printer toner age; first printer toner concentration; first printer area coverage; first printer streaks; first printer development field; first printer laser power; first printer charge level;

determining a second printer stress state of the second printer of the printing system, wherein said step of determining the second printer stress state comprises receiving second printer stress data from said second printer, said second printer stress data comprising data that relate to a plurality of second printer stress parameters including at least two of: second printer toner age; second printer toner concentration; second printer area coverage; second printer streaks; second printer development field; second printer laser power; second printer charge level;

comparing said first printer stress state to said second printer stress state, wherein said step of comparing said first printer stress state to said second printer stress state comprises:

(i) calculating a difference between each of said corresponding first and second printer stress parameters;

(ii) comparing each said difference to a corresponding select printer parameter threshold;

(iii) determining that the first printer stress state is different than the second printer stress state if at least one of said differences exceeds its corresponding select printer parameter threshold;

reassigning said first printing role of the print job to said second printer and reassigning said second printing role of the print job to said first printer if said first printer stress state is different than said second printer stress state;

wherein said step of reassigning said first printing role of the print job to said second printer and reassigning said second printing role of the print job to said first printer comprises:

sending print data defining said first printing role of said print job to said second printer and using said second printer to print said data defining said first printing role;

sending print data defining said second printing role of said print job to said first printer and using said first printer to print said data defining said second printing role.

2. The printer stability enhancement method as set forth in claim 1, wherein said step of reassigning said first printing role to said second printer and reassigning said second printing role to said first printer further comprises:

changing a paper path between said first printer and said second printer from a first state where said first printer prints on a first side of a paper sheet and said second printer prints on a second side of said paper sheet to a second state where said first printer prints on a second side of said paper sheet and said second printer prints on a first side of said paper sheet.

3. The printer stability enhancement method as set forth in claim 1, wherein said first printer stress data is related to said first printer stress parameters including each of: first printer toner age; first printer toner concentration; first printer area coverage; first printer streaks; first printer development field; first printer laser power; first printer charge level.

4. The printer stability enhancement method as set forth in claim 3, wherein said second printer stress data is related to said second printer stress parameters including each of: second printer toner age; second printer toner concentration; second printer area coverage; second printer streaks; second printer development field; second printer laser power; second printer charge level.

5. A system for printer stability enhancement in a multiple printer printing system, said system comprising:

means for determining a first printer stress state of a first printer in a printing system, said first printer assigned a first printing role of a print job, wherein said means for determining the first printer stress state comprises means for receiving first printer stress data from said first printer, said first printer stress data comprising data that relate to a plurality of first printer stress parameters including at least two of: first printer toner age; first printer toner concentration; first printer area coverage; first printer streaks; first printer development field; first printer laser power; first printer charge level;

means for determining a second printer stress state of a second printer in said printing system, said second printer assigned a second printing role of the print job that is different from said first printing role;

means for comparing said first printer stress state to said second printer stress state, wherein said means for comparing said first printer stress state to said second printer stress state comprises:

(i) means for calculating a difference between each of said corresponding first and second printer stress parameters;

(ii) means for comparing each said difference to a corresponding select printer parameter threshold;

(iii) means for determining that the first printer stress state is different than the second printer stress state if at least one of said differences exceeds its corresponding select printer parameter threshold;

means for reassigning said first printing role of the print job to said second printer and reassigning said second printing role of the print job to said first printer if said first printer stress state is different than said second printer stress state;

wherein said means for reassigning said first printing role to said second printer and reassigning said second printing role to said first printer comprises:

means for sending print data defining said first printing role of said print job to said second printer; and, means for sending second print data defining said second printing role of said print job to said first printer.

6. The printer stability enhancement system as set forth in claim 5, wherein said means for reassigning said first printing role to said second printer and reassigning said second printing role to said first printer further comprises:

means for changing a paper path between said first printer and said second printer from a first state where said first printer prints on a first side of a paper sheet and said second printer prints on a second side of said paper sheet to a second state where said first printer prints on a second side of said paper sheet and said second printer prints on a first side of said paper sheet.

7. The printer stability enhancement system as set forth in claim 5, wherein said first printer stress data is related to said first printer stress parameters including each of: first printer toner age; first printer toner concentration; first printer area coverage; first printer streaks; first printer development field; first printer laser power; first printer charge level.

8. The printer stability enhancement system as set forth claim 7, wherein said second printer stress data is related to said second printer stress parameters including each of: second printer toner age; second printer toner concentration; second printer area coverage; second printer streaks; second printer development field; second printer laser power; second printer charge level.

* * * * *